United States Patent [19]

Dubach

[11] Patent Number: 4,911,324

[45] Date of Patent: Mar. 27, 1990

[54] PLASTIC SNAP HINGE CLOSURE

[75] Inventor: Werner F. Dubach, Maur, Switzerland

[73] Assignee: Alfatechnic AG, Switzerland

[21] Appl. No.: 237,973

[22] Filed: Aug. 29, 1988

[30] Foreign Application Priority Data

Sep. 25, 1987 [CH] Switzerland ..... 3729/87

[51] Int. Cl.[4] ..... B65D 41/28

[52] U.S. Cl. ..... 220/339; 215/237; 222/498; 222/556

[58] Field of Search ..... 220/339; 222/498, 556; 215/235, 237

[56] References Cited

U.S. PATENT DOCUMENTS

| | | | |
|---|---|---|---|
| 2,630,239 | 3/1953 | Paull et al. | 220/339 |
| 3,227,332 | 1/1966 | Gowdy et al. | 222/498 X |
| 3,629,901 | 12/1971 | Wolf et al. . | |
| 3,741,447 | 6/1973 | Miles et al. | 222/498 X |
| 3,986,627 | 10/1976 | Zapp | 215/237 |
| 3,998,354 | 12/1976 | Song | 220/339 X |
| 4,386,714 | 6/1983 | Roberto et al. . | |
| 4,403,712 | 9/1983 | Wiesinger | 220/339 |
| 4,573,600 | 3/1986 | Dubach . | |

*Primary Examiner*—Stephen M. Hepperle
*Attorney, Agent, or Firm*—Thomas W. Speckman; Douglas H. Pauley

[57] ABSTRACT

A plastic closure having a lower part and an upper part that fit together, the upper part being connected to the lower part by a film hinge. The upper part has, on its inner side, an extending portion with projecting sealing elements which form, with the outlet of a container, a sealing connection. The upper part is additionally connected with the lower part in a pivoting manner by a snap hinge. The snap hinge is connected with the upper part by a film hinge, and connected with the lower part by a film hinge. For purposes of opening, the film hinge connecting the upper part and the lower part is bent. The closure can be placed or screwed onto a container with its lower part. The closure can be produced in a closed condition.

13 Claims, 3 Drawing Sheets

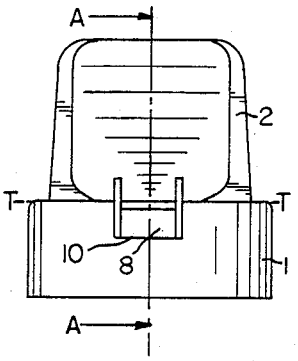
FIG.1
FIG.2
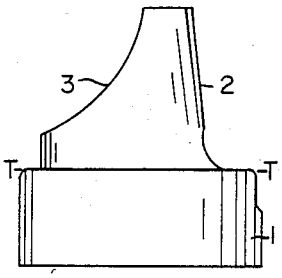
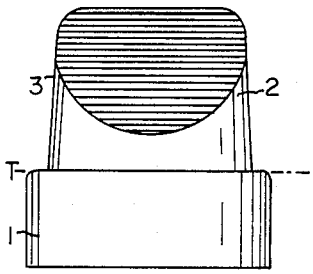
FIG.3
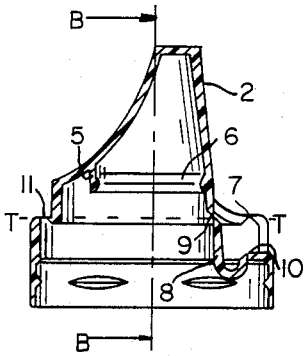
FIG.4
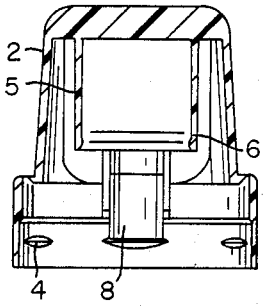
FIG.5
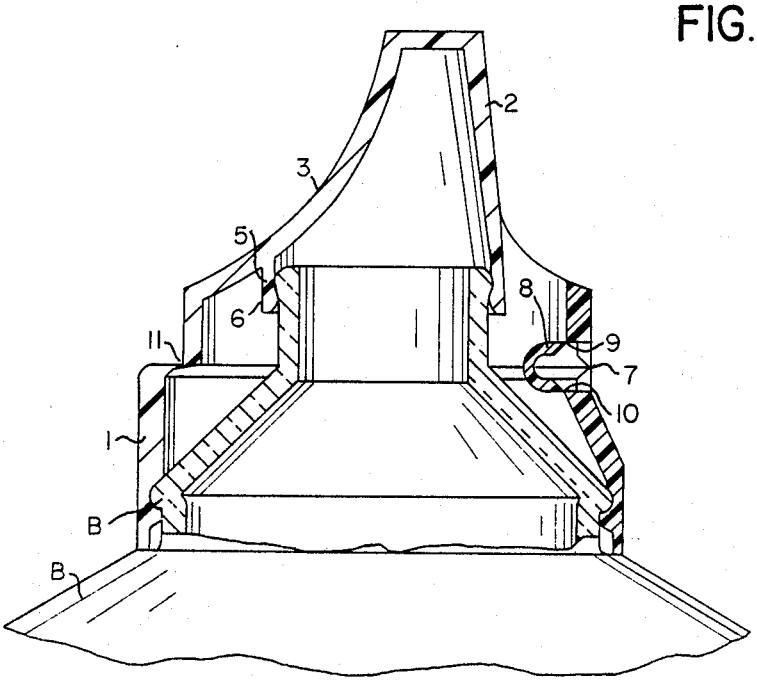
FIG.6

FIG. 7
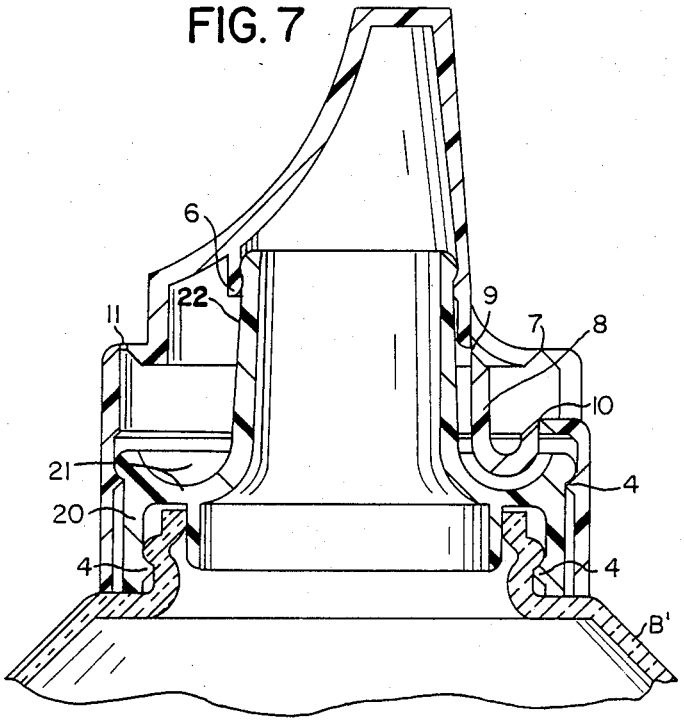
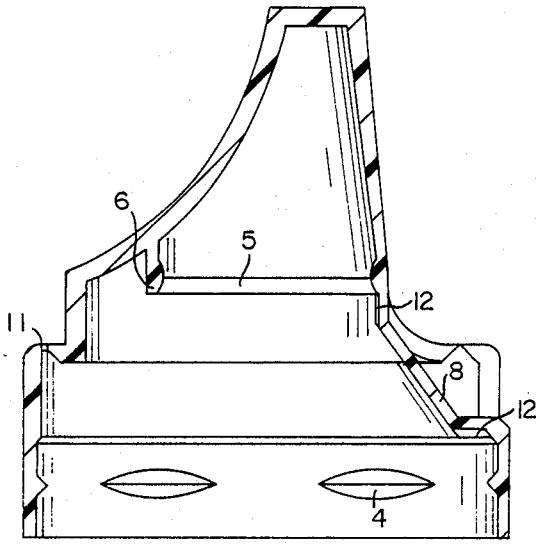
FIG. 9

PLASTIC SNAP HINGE CLOSURE

BACKGROUND OF THE INVENTION

The present invention concerns a snap hinge closure of plastic with a lower part, and an upper part integrally connected by means of at least one hinge. The upper part is constructed as a cap or cover, as well as an element producing the snapping effect, which can be elastically molded, and which can be effectively connected with both parts during the closing and opening process.

Such closures have been available for many years, and in numerous forms of constructions. As examples of such closures, there should be mentioned those described in the U.S. Pat. Nos. 3,629,901; 4,386,714; and 4,573,600.

Closures comprise an essential part of the packaging of a product. This must be constructively adapted, depending on the type and form of the container onto which the closure is to be attached, and depending on the functional requirements placed on the closure. The physical characteristics of the product to be packaged also have an influence on the formation of a closure. Finally, the closure also has the function of individualizing the packaged product. All of these requirements have led to large number of closures, which are formed in many varied manners. Plastic closures are manufactured by means of typical mass production processes. High initial costs for the development and production of the necessary molds for injection molding are connected with this, which stands in direct contradiction to the desired diversity, which tends strongly to a reduction in the number of parts necessary.

SUMMARY OF THE INVENTION

It is an object of the present invention to create a snap hinge closure which is suited, in its basic construction, to many varied containers and varied products, so that it can be produced by means of mass production, and can then be adapted, with only a few means, for any specific application.

Such a closure, which is suited for different packages, can then be manufactured in enormous numbers of units. Nevertheless, such a closure would still not be competitive in price, for example, relative to a simple rotating closure. This is due to the fact that snap hinge closures comprise two connected parts which are extruded in a single piece, but in a completely open position, however. Consequently, the surface required per closure in the extrusion tool is approximately twice as great as with a simple, one-part closure. In addition to this, such a two-part closure must in addition still be closed. This takes place after the extrusion process, and expensive machinery, by means of which the closures must be separated, aligned, and closed, is necessary. In other techniques, such closures are closed, immediately after manufacturing, the extrusion machine is closed by means of corresponding levers, and these are then expelled. The first variant is expensive in its machinery. The second variant is only applicable provided that not too great a number of cavities are provided in the tool, and, furthermore, this extends the cycle times to a considerable degree.

It is another objective of the present invention to create a snap hinge closure having a lower part and upper part integrally connected by means of at least one hinge, the upper part constructed as a cap having an elastically moldable snap element connected with both the lower part and the upper part and producing a snapping effect during closing and opening of the closure which can also be manufactured, even in very large unit numbers, more economically than conventional open extruded closures.

The present invention achieves both objects stated above by means of a snap hinge closure of plastic with a lower part, and an upper part integrally connected by means of at least one hinge. The upper part is constructed as a cap or cover, as well as an element producing the snapping effect, which can be elastically molded, and which can be effectively connected with both parts during the closing and opening process. The lower part, by omitting a closing surface with an outlet, comprises only a circular annular wall, on which there are provided projecting closing means for attachment to a container or to an adapter part, so that the lower part and upper part can be produced above one another in the closed position.

The invention, which has a surprisingly large range of significance, comprises the ingeniously simple method of omitting the generally large closing surface on the lower part, which contains the outlet, which has previously been present. Through this means, space is created, so that the lower tool part can form the entire internal surface of the closure. By this means, the production of the snap hinge closure in a closed position is made possible for the first time.

A disadvantage which appears at a first glance, namely, that an adapter piece is now necessary for different containers which have no closing surface with an outlet specific to the container, is shown, upon a more detailed examination, to actually present an additional advantage. This adapter piece is very simple in its form. In particular, it is rotationally symmetrical, and can therefore be produced in a manner specific to the container, even in relatively small unit numbers. It can also be designed in a different color than that of the actual closure. Both parts, namely, the adapter part and the closure, work in common as a single part. Nonetheless, by means of small form and color variations of the adapter part, a high degree of individualization of the entire part can be attained.

BRIEF DESCRIPTION OF THE DRAWING

Specific embodiments in accordance with the invention are illustrated in the following description by means of the attached drawing, wherein:

FIGS. 1–3: Back, side and front view, respectively, of one embodiment of the closure in accordance with this invention;

FIG. 4: A sectional view along the line A—A of FIG. 1;

FIG. 5: A sectional view along the line B—B of FIG. 4;

FIG. 6: A side sectional view of another embodiment of a closure of this invention in mounted condition, with different snap hinge;

FIG. 7: A side sectional view of another embodiment of a closure of this invention with an inserted adapter part;

FIG. 9: A simplified side sectional view of another embodiment of a snap closure with a clamping band.

DESCRIPTION OF PREFERRED EMBODIMENTS

Figure 8:
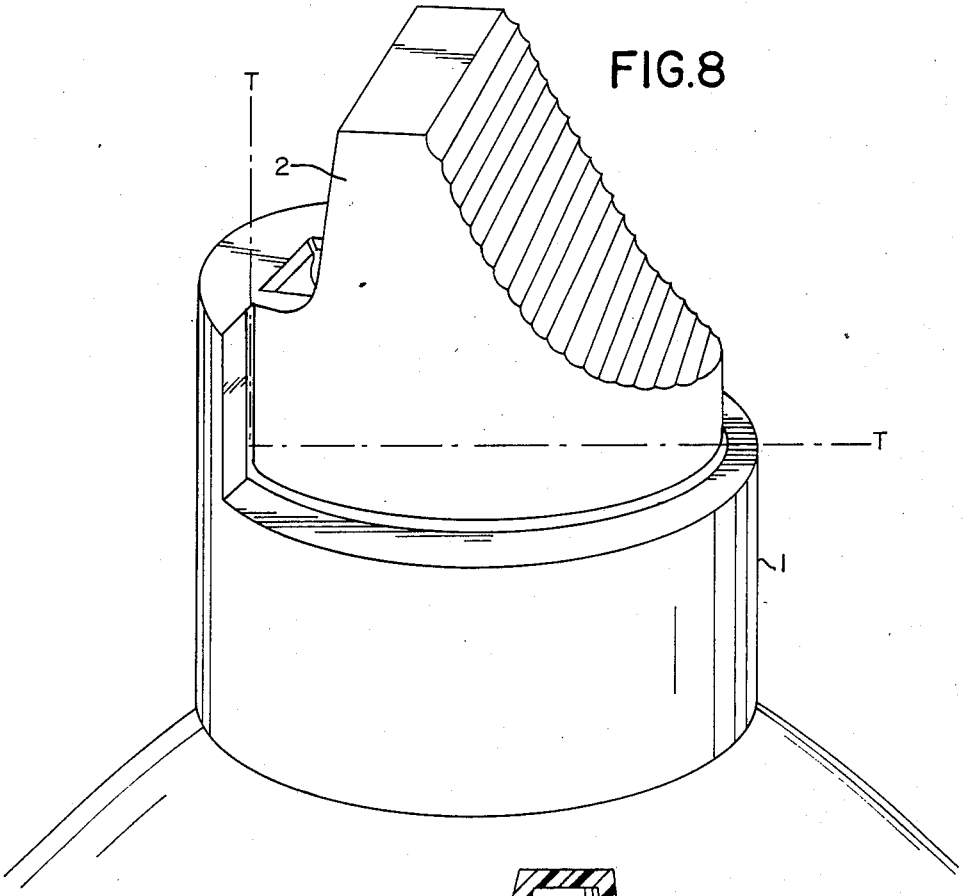
FIG. 8: A simplified perspective view showing an angled joint plane between the upper and the lower part.

It can be clearly seen in the lateral views of Figs. 1 to 3 both primary components (1, 2), which are connected with one another in a single unit, namely, the cylindrical lower part (1) and the upper part (2), which proceeds upwardly with essentially a gable shape. On one side, the upper part (2) is provided with a concavely arched pressure depression (3), which serves the purpose of opening the closure by means of thumb pressure. The joint surface (T) proceeds precisely on the upper edge of the lower part (1). This joint surface (T) is also again shown in dotted lines in the sectional drawing in FIG. 4. The lower part (1) comprises a circular wall, from the inner side of which several circularly positioned bulges (4) protrude. These bulges (4) serve as closing means, which are suited for the attachment of the closure to a correspondingly shaped container. As will be illustrated later, these bulges (4) can also serve to hold an adapter part which is inserted, and which further produces the connection with the container on which the closure is placed.

What is particularly striking is that the horizontal closing surface which is otherwise customary is omitted here. In the case of the conventional closure, this would lie on the joint surface. If, however, this closing surface, which is usually provided with a nozzle-shaped outlet, is present, then, in the closed position of the closure depicted, the hollow space could no longer be formed under the cover. In many cases, however, the container on which the closure is placed already has this closing surface and the nozzle-shaped outlet. For example, this holds true for all tubes. If the closure depicted is placed on a tube, then the bulges (4) engage directly below the shoulder part of the tube in the cylindrical wall area of the same. The nozzle-shaped outlet, which is generally provided with an external threading, now projects through the lower part (1) into the upper part (2). A sealing leg (5) with an annular bulge (6) encircles this nozzle, and thereby seals the special cap (2) against the container.

The upper part (2) and the lower part (1) are connected with one another by means of a film hinge (7) lying on the joint surface (T). The lower part (1) and the upper part can be pivoted relative to one another around this film hinge (7). The film hinge (7) is actually divided into two parts, which lie on both sides of an elastically moldable element (8) producing the snapping effect. In the present case, this element (8) comprises a bent, relatively thick, elastic plate, which is connected by means of a film hinge, on the one side, with the upper part (2), and, on the other side, with the lower part (1). The film hinge (9) producing the connection with the upper part (2) lies at least approximately in the joint surface (T), while the film hinge (10) forming the connection with the lower part (1) lies at least roughly vertically below the film hinge (7) described previously. During the opening and closing process, the pivoting point moves between the element (8) and the upper part (2), through the pivot axis formed by the film hinge (7), whereby the element (9) is stretched and thus develops the force necessary for the snapping.

In the area which lies opposite the snapping hinge, one or more bridges (11) lying in the joint surface (T) can be attached between the upper and the lower part. Through this means, the closure can, in the simplest manner, also provide a guarantee of security from damage for the packaged product.

In the version in accordance with FIG. 6, shown enlarged, the closure is shown placed on a tube. The container is designated by (B). Relative to the construction described previously, essentially only the snapping hinge is constructed differently here. The elastic element (8) is here positioned relatively close to the film hinge (7), which connects the upper and lower part, and can thus be constructed to be correspondingly smaller. No further discussion will be provided regarding the additional remaining parts, which are otherwise equal.

FIG. 7 depicts one preferred embodiment for bottle-like containers (B'). In the actual snapping closure, which only represents one enlarged variant corresponding to the embodiment shown in FIGS. 1 to 5, an adapter piece (20) is inserted here. This is a simple, completely symmetrical part, which can be extruded in an economical manner. This adapter part has the otherwise usual horizontal closing wall (21) with a central, nozzle-shaped outlet (22). This adapter piece (20) serves for the connection of the closure with a container (B'). Such an adapter part (20) can be specifically adapted to the container neck, such as by projections (4). The adapter can, obviously, be produced in any color desired, even in one differing from the color of the actual closure, and thereby serves as the simplest manner of individualizing the product to be packaged.

FIG. 8 serves only to show the multiplicity of different forms of execution of the closure of this invention. Here, for example, the joint surface is gradated between the upper part (2) and the lower part (1). This makes it possible to shift the actual snap hinge from the area of the periphery toward the center. The film hinge (7) connecting both principal parts (1 and 2) now lies in the vertically proceeding area of the joint surface (T).

Another embodiment of the closure is shown in FIG. 9, in a purely schematic manner, in which the elastically moldable element (8) producing the snapping effect is a clamping band formed in a stretched manner, which is under tension in the area of its elastic deformation during the opening and closing of the closure.

Figure 10:
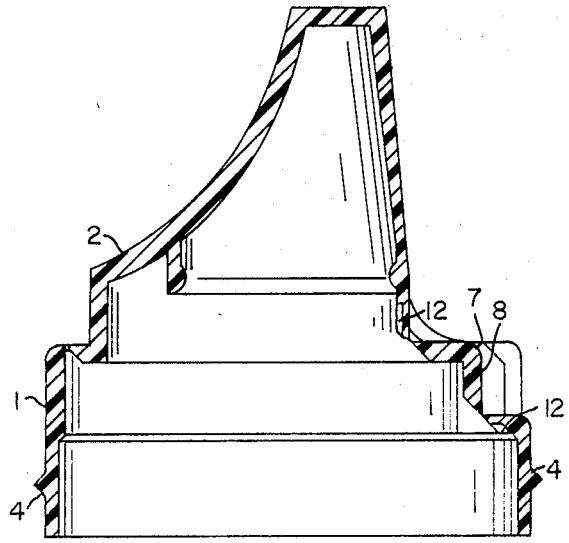
FIG. 10: A side sectional view showing another embodiment of a snap closure having a differently shaped snap hinge.

Another embodiment of the snap hinge is shown in FIG. 10. The element (8) producing the elastic spring effect is formed here in the form of a lever having one bend. This bent lever is, during the opening or the closing of the closure, extended more or less sharply. In order to not require too large a bent lever, the wall areas (12) adjoining the element (8) can be formed in a flexible manner. This takes place most simply through a reduction of the wall thickness or through the application of slots.

It is also an important characteristic that the adapter part (20) can be produced from polyethylene. Snap hinge closures must, because of the strength and the stresses of the element producing the flexibly elastic effect, as well as because of the film hinges, be made from polypropylene. This material is relatively hard. If, however, the adapter piece is produced from the softer material, polyethylene, this provides a better sealing. This provides, moreover, still further advantages, since such an adapter piece can be directly melded wit the foil of a tube, and finally, there also results cost savings as well, because polyethylene is 20–30 percent cheaper than polypropylene.

Without going into further detail here, it is clear that the snap hinge closure in accordance with this invention can also have all the additional elements which can otherwise be attached with conventional snap hinge closures. In particular, there should be mentioned here the corresponding safety bands.

I claim:

1. A plastic snap hinge closure comprising a lower part (1) and an upper part (2) integrally connected by means of at least one first film hinge (9), said upper part (2) constructed as a cap having an elastically moldable snap element (8) connected with both said lower part (1) and said upper part (2) which produces a snapping effect during closing and opening of the snap hinge closure, said lower part (1) having a lower circular wall on which are inwardly projecting connecting means (4) for attachment to a container (B) having an outlet in a form of a spout, said outlet protruding beyond an upper edge of said lower circular wall and said lower circular wall surrounding said outlet at a radial distance in a mounted condition of the snap hinge closure, said upper part (2) having a joint plane (T) between said upper edge of said lower part (1) and a lower edge of an outer circular wall of said upper part (2), in a closed position of the snap hinge closure said upper edge abutting said lower edge, said upper part (2) having at least one sealing element (6) positioned on an inner side which is aligned with and sealable against said outlet of said container (B), and in the closed position of the snap hinge closure said upper part (2) and said lower part (1) forming a hollow volume with a tapered shape from a top of said upper part (2) to a bottom of said lower part (1) whereby the snap hinge closure is injection molded in the closed position.

2. A snap hinge closure in accordance with claim 1 wherein said snap hinge comprises a second film hinge (7) positioned in said joint plane (T) between said upper part (2) and said lower part (1), said snap element (8) being connected to said upper part (2) by means of a first film hinge (9) above said joint plane (T) away from the periphery of said lower part (1) toward a center of said closure, and said snap element (8) being connected to said lower part (1) by means of a third film hinge (10) which is positioned below said second film hinge (7) which directly connects said upper part (2) and said lower part (1).

3. A snap hinge closure in accordance with claim 1 wherein said snap element (8) is formed in a curved shape.

4. A snap hinge closure in accordance with claim 1 wherein said snap element (8) is an elastic band.

5. A snap hinge closure in accordance with claim 1 wherein said snap element (8) has at least one bend.

6. A snap hinge closure in accordance with claim 1 wherein the wall areas (11) on at least one of said upper and said lower part adjoining said snap element (8) are flexible.

7. A snap hinge closure in accordance with claim 1 wherein said upper and lower parts are polypropylene and said adapter part (2) is polyethylene.

8. A snap hinge closure in accordance with claim 1, wherein said upper part (2) and said lower part (1) are connected with one another by means of bridge units, which serve as security against damage.

9. A snap hinge closure in accordance with claim 8 wherein each said bridge unit lies in said joint plane (T).

10. A snap hinge closure in accordance in claim 1, wherein a surface of said joint plane (T) forms a step between said upper part (2) and said lower part (1).

11. A snap hinge closure in accordance with claim 1 wherein said upper part (2) is formed in a gable shape and has at least one outer surface with a depression to which pressure is applied.

12. A snap hinge closure in accordance with claim 1 wherein said outlet formed as said spout is integrally formed with said container (B).

13. A snap hinge closure in accordance with claim 1 wherein said outlet comprises an adapter part (20) fixedly connected to said container (B) and said lower part (1) is secured to said adapter part (20) by said inwardly projecting connecting means (4).

* * * * *